US005755618A

United States Patent [19]

Mothwurf

[11] Patent Number: 5,755,618

[45] Date of Patent: May 26, 1998

[54] APPARATUS FOR STORING COINS OR COIN-LIKE ARTICLES

[75] Inventor: Ewald Mothwurf, Graz, Austria

[73] Assignee: Grips Electronic GmbH, Graz, Austria

[21] Appl. No.: 631,351

[22] Filed: Apr. 12, 1996

Related U.S. Application Data

[63] Continuation-in-part of Ser. No. 573,618, Dec. 15, 1995.

[30] Foreign Application Priority Data

Sep. 14, 1995 [AT] Austria ..... 1529/95
Nov. 3, 1995 [AT] Austria ..... 1820/95

[51] Int. Cl.[6] ..... G07D 9/00

[52] U.S. Cl. ..... 453/17; 453/58

[58] Field of Search ..... 453/17, 58, 60; 273/148 R

[56] References Cited

U.S. PATENT DOCUMENTS

| | | | |
|---|---|---|---|
| 3,605,970 | 9/1971 | de Crepy | 453/17 X |
| 4,531,187 | 7/1985 | Uhland | 364/412 |
| 4,614,342 | 9/1986 | Takashima | 273/85 CP |
| 4,755,941 | 7/1988 | Bacchi | 273/148 R X |
| 4,774,841 | 10/1988 | Chadwick | 453/17 X |
| 5,078,405 | 1/1992 | Jones | 273/309 |

FOREIGN PATENT DOCUMENTS

| | | | |
|---|---|---|---|
| 0310761 | 4/1989 | European Pat. Off. . | |
| 0416751 A2 | 3/1991 | European Pat. Off. . | |
| 0607823 A1 | 7/1994 | European Pat. Off. . | |
| 2651105 | 5/1978 | Germany | 453/17 |
| 3128094 | 2/1983 | Germany . | |
| 3137484 A1 | 4/1983 | Germany . | |
| 3403018 A1 | 8/1985 | Germany . | |
| 3436287 A1 | 4/1986 | Germany . | |
| 3515890 A1 | 11/1986 | Germany . | |
| 3939450 A1 | 6/1991 | Germany . | |
| 4328792 C1 | 12/1994 | Germany . | |
| 4439502 C1 | 9/1995 | Germany . | |
| 573 635 | 3/1976 | Switzerland | 453/17 |
| 2269256 | 2/1994 | United Kingdom | 453/17 |

OTHER PUBLICATIONS

Soviet Inventions Illustrated, Section E1, (Abstracts) week 8535, London: Derwent Publications Ltd., N85 162 294, T04, T05, SU 1140 137 A (Don Giprougleavtoma), Oct. 9, 1985.

*Primary Examiner*—F. J. Bartuska
*Attorney, Agent, or Firm*—Townsend and Townsend and Crew LLP

[57] ABSTRACT

Apparatus for storing coins or coin-like articles, such as for example gaming chips, tokens or the like, wherein the coins or coin-like articles to be stored are arranged against one another or above one another in at least one column, with this apparatus having a mechanism for determining the number of coins or coin-like articles present in the apparatus. The mechanism for determining the number of coins or coin-like articles present in the apparatus is formed by a plurality of transmitter/receiver pairs such as, for example, ultrasonic transmitters/receivers, light transmitters/receivers or the like arranged in rowssubstantially parallel to the column(s) of coins or coin-like articles.

23 Claims, 7 Drawing Sheets

APPARATUS FOR STORING COINS OR COIN-LIKE ARTICLES

RELATED APPLICATIONS

This is a continuation-in-part copending application of U.S. Ser. No. 08/573,618, filed Dec. 15, 1995 for APPARATUS AND METHOD FOR DATA GATHERING IN GAMES OF CHANCE.

FIELD OF INVENTION

The invention relates to an apparatus for the storage of coins or coin-like articles, such as gaming chips, tokens or the like, wherein the coins or coin-like articles to be stored are arranged against or above one another in at least one column, with this apparatus having a mechanism for determining the number of coins or coin-like articles present in the apparatus.

BACKGROUND OF THE INVENTION

In order to store, for example, coins in an orderly and easily inspected manner, they are frequently stacked in columns above one another. It is, however, a disadvantage of this arrangement that, when coins are taken from the column, the latter can collapse with inattentive handling.

This problem of collapse is prevented when using containers which have recesses corresponding in their width essentially to the diameter and in their depth essentially to the radius of the column of coins to be accommodated. Through such recessed arrangements, the column is well supported and can be stored vertically or approximately horizontally. The use of such a container is sensible where relatively many coins or coin-like articles have to be handled, i.e. when new coins have to be frequently added to the stack or removed from the column. The most common examples are station ticket counters, and cash tills in general and gaming casinos.

Particularly with the casinos a large number of gaming chips must be accepted by the croupier within a short period of time and deposited as well as handed out. The disadvantage of the so-called "chip trays" previously used for this purpose is that the number of chips present in the chip tray was substantially unknown or could only by determined by estimation or tiresome recounting.

Some have employed the method of measuring the height of the columns of articles and calculating the number of articles present in the column by dividing this height by the thickness of an individual article of the column. A refinement of this method can be achieved in that a scale is mounted alongside the column which is labelled not in units of length, but rather directly with the number of articles.

The most important disadvantages of this method are that the scale often becomes unreadable in the course of time with frequent handling of the container, and thus unusable, and that it can only be read by a human and can thus not be processed further with data processing assistance.

OBJECTS OF THE INVENTION

One object of the invention is to avoid the cited disadvantages.

The prinipal object of the present invention is to provide a chip tray having an apparatus for automatically, accurately and reliably detecting the number of coins or coin-like articles present in each column.

A further object is to provide a chip tray which can readily display the value of its contents to an operator and which can be coupled to a computer system to facilitate data entry, data output and data transfer functions.

BRIEF DESCRIPTION OF THE INVENTION

These objects are satisfied in accordance with the invention in a column type apparatus in that the mechanism for determining the number of coins or coin-like articles in the apparatus is formed by a number of transmitter/receiver pairs, such as ultrasonic transmitters/receivers, light transmitters/receivers or the like which are arranged substantially parallel to the jacket surface(s) of the column(s) of the coins or coin-like articles.

Such transmitter/receiver pairs can be electronically controlled in a particularly simple manner, and the results of a measurement carried out with such elements can be readily processed by electronic data processing systems. A further processing of this kind is of particular importance in gaming casinos because it is desirable for the monitoring of the various table games, such as Black Jack, Poker, and American roulette, to determine the performance of the croupier, dealer, or table teams in order, for example, to be able to fundamentally investigate irregularities in performance.

In a further embodiment of the invention, which is formed with separators extending parallel to and spaced apart from one another for the purpose of storing several parallel columns of coins or coin-like articles, provision can be made for the transmitter/receiver pairs which serve for the determination of the number of coins or coin-like articles present in the apparatus to be arranged within the separators.

Through an arrangement of this kind, the transmitters and receivers are well protected against mechanical damage; furthermore, the easy handling of the apparatus, i.e. the insertion and removal of coins or coin-like articles, is not disadvantageously influenced in any way.

In a further development of the invention, provision can be made that only transmitters or only receivers are arranged within each separator and that the separators containing transmitters and the separators containing receivers are alternately arranged alongside one another.

With a design of this kind, a particularly simple layout results for each transmitter or receiver module, whereby, as a further consequence, simple exchangeability of a whole module is possible.

In this regard provision can be made that both the individual transmitters and the individual receivers are arranged to be aligned in rows at a constant spacing, and that the receivers are arranged to be displaced relative to the transmitters by half the receiver-to-receiver spacing.

With a displaced arrangement of this kind, one transmitter can transmit to two receivers in each case, whereby a doubling of the measurement accuracy can be achieved in a simple manner.

A particularly preferred embodiment of the invention comprises transmitter/receiver pairs that include optical transmitters and receivers, preferably by infrared transmitters and receivers.

These types of transmitters and receivers are mass-produced, and are thus relatively favorably priced and contribute to keeping the cost of production of the apparatus low. They are well suited to the design of the light barriers necessary for this application.

It can be particularly advantageous for each transmitter to transmit two light beams which are displaced through 180° relative to one another and extend substantially transversely to the separators, and for each receiver to have two sensitivity lobes displaced through 180° relative to one another and extending substantially transversely to the separators.

In this way, the function of two elements can be satisfied by each transmitter and receiver element, with the number of the components which are necessary for the design of the measurement device being reduced and, as a further consequence, with the control electronics also being substantially simplified, and thus with a particularly, reliable and favorable overall layout being possible.

In a further development of the invention, a microcontroller can be provided which, on the one hand, controls the mechanism for determining the number of coins or coin-like articles present in the apparatus and, on the other hand, calculates the number of coins or coin-like articles present in the apparatus from the signals received from the mechanism.

With the aid of a microcontroller, the control signals necessary for the control of the measurement mechanism can be produced in a simple manner. Furthermore, with a system of this kind operating parameters can be changed particularly simply, so that an adaption of the overall measuring device to the different thicknesses of the coins or coin-like articles present in the stack can be carried out.

In this regard, provision can furthermore be made for the mcirocontroller to be equipped with an EEPROM.

The operating parameters necessary for the orderly functioning of the system can be stored in a non-volatile manner in such storage media so that, even after a failure of the supply voltage, the correct operation is ensured with the last set parameters.

Furthermore, provision can also be made for the microcontroller to be connected to optical display elements arranged beneath the columns of coins or coin-like articles.

In this way, the type of coins or coin-like articles contained in the respective columns, or their actual number, can be displayed to the person entrusted with the handling of the apparatus of the invention.

In a further embodiment of the invention, provision can be made for the microcontroller to be connected with an input terminal.

In this way, the necessary operating parameters, such as for example the thickness of the coins or coin-like articles to be received, can be input in simple manner.

In a further embodiment of the invention, provision can be made for the microprocessor to be connected to a central processing unit.

In particular, when several apparatuses in accordance with the invention are simultaneously in operation, they can be monitored and their function influenced in a simple manner with the aid of such a central processing unit.

LISTING OF THE FIGURES

FIG. 1 illustrates an apparatus of the invention in plan view,

FIG. 2 illustrates the apparatus of the invention in section and in elevation, FIG. 3 illustrates a transmitter element in elevation and in section, FIG. 4 illustrates a schematic arrangement of the transmitter and receiver in plan view, FIG. 5 is a schematic illustration of the apparatus of the invention when used at a gaming table, FIG. 6 is a clock circuit diagram of a microcontroller which controls the apparatus, FIG. 7 is a detailed block circuit diagram of the microcontroller of FIG. 6, FIG. 8 illustrates the control of the transmitter in detail in the form of a block circuit diagram, FIG. 9 illustrates the control of the receiver in detail in the form of a block circuit diagram, and FIG. 10 illustrates the control of the display elements in detail.

DESCRIPTION OF THE PREFERRED EMBODIMENTS

Figure 5:
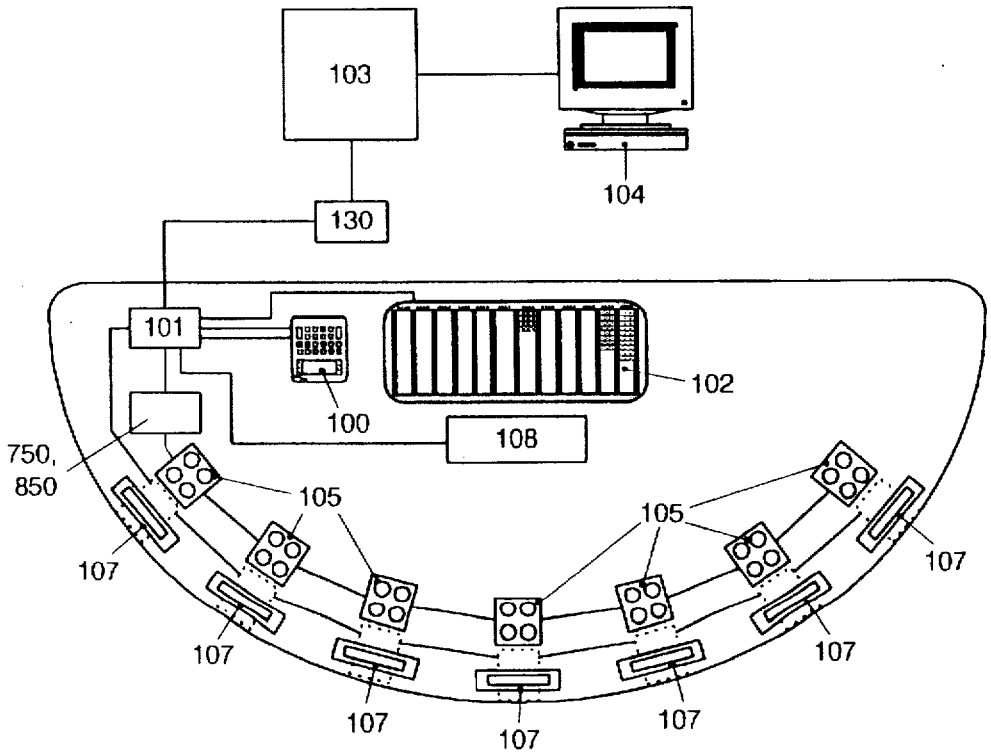

The most important field of application of the invention, which is however only recited to improve the explanation but should not in any way be regarded as a restriction of this field of application, is a computer assisted data gathering system for gaming tables of a casino. This application is schematically illustrated in FIG. 5. The drawing of FIG. 5 schematically illustrates a gaming table having betting squares 105 for the individual players. The dealer has a chip tray 102 in which the dealer places gaming chips taken from the players' betting squares 105 when they lose and from which he can if necessary take chips to pay out players' winnings. Moreover, players can buy gaming chips from the dealer and these are also taken by the dealer from the chip tray.

It is important for the dealer and the casino operators to know the value of gaming chips present in the chip tray at any time, e.g. at the start of gaming and after each hand has been played. For this purpose a data gathering system is provided and includes the chip tray 102 of the present invention.

The data gathering system of FIG. 5 is described in detail in copending U.S. application U.S. Ser. No. 08/573,618. Basically it includes, in addition to the chip tray 102, a gaming status sensor 108 which permits automatic detection of the hands that are played, chip sensors (not shown) associated with each betting square 105, reading units 107 for reading player identity cards and identifying each player with a particular betting square 105, as well as a keyboard 100 for manually inputting information into the data gathering system. These items of equipment are all connected to an interface bus 101 which routes the data via an interface module 130 to a communication processor 103 and from there to a data processing system 104. The communication processor serves to adapt the signal shape delivered via the interface bus to a signal shape which can be processed by the data processing system 104. The components designated with reference characters 750 and 850 are controllers which assist in the processing of the signals from the betting squares 105.

A data gathering system of this kind serves to establish the performance of the croupier, of the dealer, and of the table team and makes it possible to observe the development of the results of the gaming table.

Figure 1:
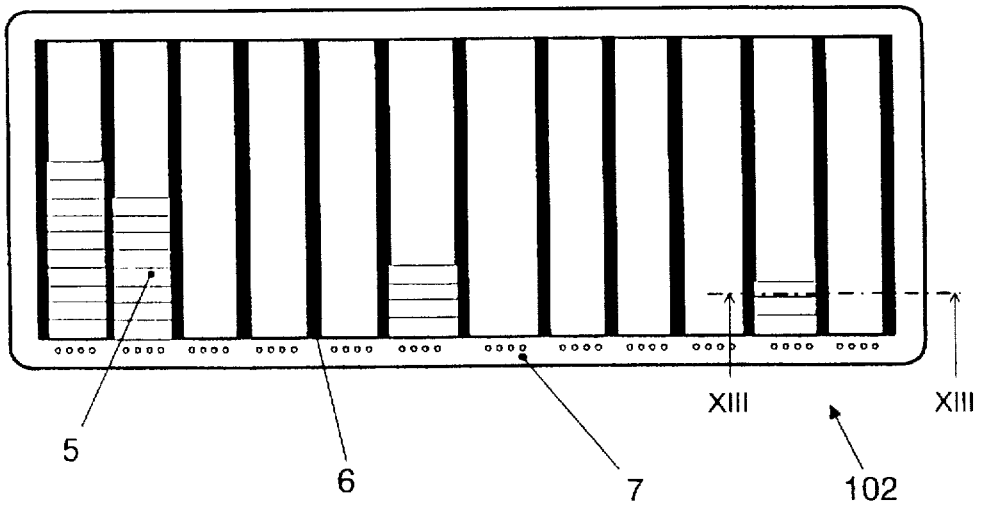

Referring to FIG. 1, known apparatus for storing coins or coin-like articles 5 (such as gaming chips, tokens or the like) are formed with separators 6 which extend parallel to and spaced apart from one another. These separators 6 can be arranged to form column recesses to permit the storage of several columns of coins or coin-like articles extending parallel to one another. The column recesses need not be formed fully by the separators but could, e.g., also be at least partly formed by a recess in the base of the chip tray 102. The overall arrangement, i.e. the chip tray, is typically inclined slightly relative to the horizontal so that the columns are automatically tightly packed and tight mutual contact of the individual coins or coin-like articles 5 against one another is ensured.

Figure 2:
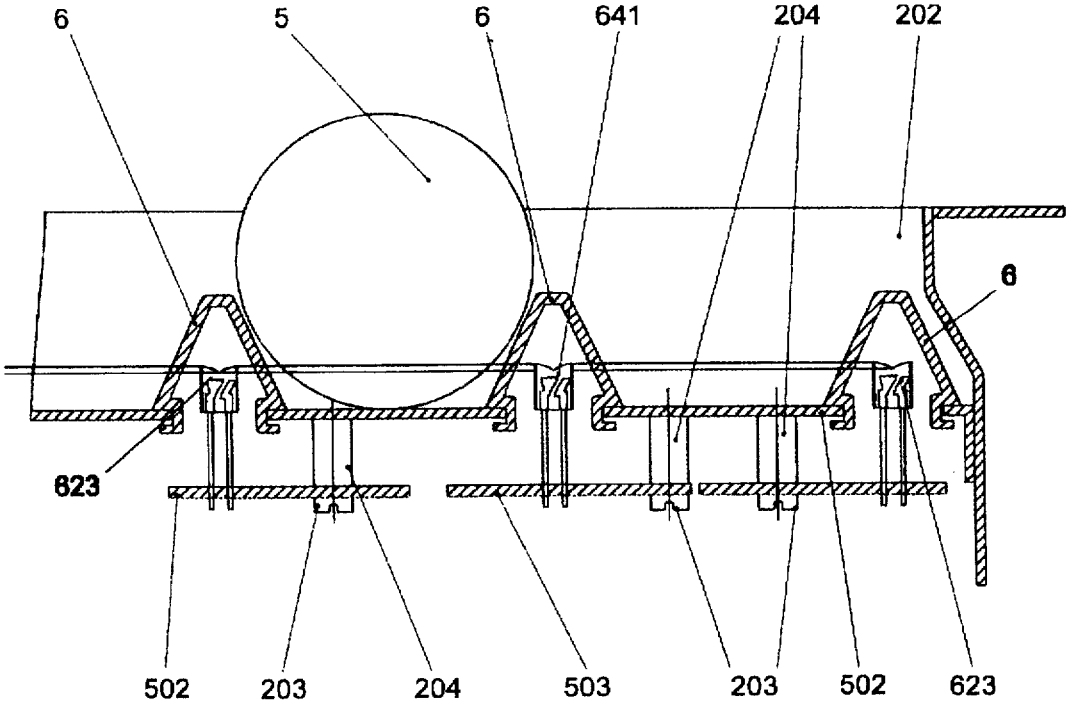

A chip tray 102 in accordance with the invention is illustrated in FIGS. 1, 2, 3 and 4 and may be manufactured in the same way as the previously known similar apparatus. One such tray 202 is shown in FIG. 2 and is made for example of sheet steel, and has separators 6 which are inserted into the tray 202.

The present chip tray 202 is distinguished from the previously known devices in that a mechanism is provided for determining the number of coins or coin-like articles 5 located in the chip tray 102 and is formed by a plurality of transmitter/receiver pairs 641, 623 such as, for example, ultrasonic transmitters/receivers, light transmitters/receivers or the like arranged substantially parallel to the jacket surfaces of the columns of coins or coin-like articles.

As can best be seen from FIG. 2, the transmitter/receiver pairs 641, 623, which serve to determine the number of coins or coin-like articles 5 located in the device, are arranged inside the separators 6. A precondition for the orderly operation of this measurement device is naturally that the separators 6 comprise a material which is permeable for the wavelength radiated from the transmitters 623 and received by the receivers 641.

In the embodiment of the invention shown in the drawings provision is made for only transmitters 623 or only receivers 641 to be arranged within each separator 6 and for separators 6 containing transmitters and receivers to be alternately arranged alongside one another.

This configuration is realized in such a way that the transmitter 623 and the receiver 641 are arranged on plate-like modules 502, 503 respectively and these modules 502, 503 are fixed to the underside of the base of the tray 202 by means of securing bolts 203 and cylindrical spacers 204.

In order to explain the determination of the number of coins or coin-like articles 5 present in a column of the chip tray, the following description assumes that the transmitter/receiver pairs 641, 623 are formed by optical transmitters and receivers, namely infrared transmitters and receivers. With the aid of this transmitter/receiver arrangement, a "light-curtain" is formed which senses the column between the separators 6 transverse to the column direction.

Wherever coins or coin-like articles 5 are located, the light curtain is interrupted, i.e. the corresponding receivers 641 cannot receive any light from their associated transmitter 623. More specifically this means that a coin or coin-like article is located in areas where a receiver 641 cannot receive light transmitted from the transmitter 623 associated therewith.

As a result of this scanning of the columns, it is also possible to track down columns which are not packed tightly in an orderly manner; gaps in the columns due to fanning out and also due to coins or coin-like articles 5 running cross-ways relative to the column are recognized by the gaps which arise in the otherwise closed column. A detection signal of this kind can activate a display and/or a shaker so that measures can be taken to establish the desired tightly packed build-up of the columns.

Figure 4:
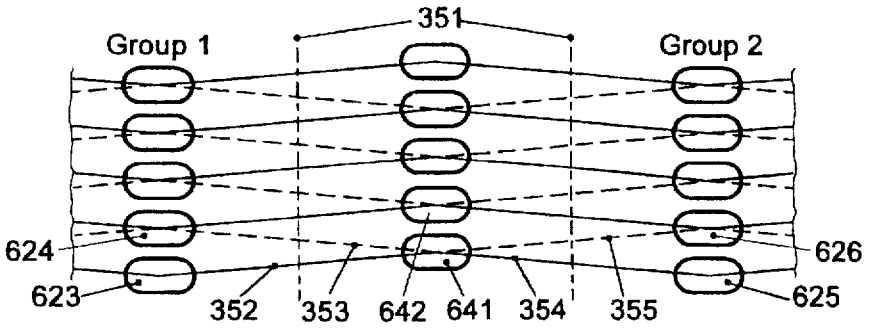

As shown in detail in FIG. 4, the transmitters used in the embodiment of the invention shown in the drawings are so laid out that they transmit two light beams which are displaced through 180° relative to one another and substantially transverse to the separators 6. Accordingly, the receivers also have two sensing lobes which are displaced relative to one another by 180° and extend substantially transversely to the separators 6. In this way a situation is achieved in which a transmitter 623 which is arranged between two columns can be simultaneously used for the sensing of both columns; that is to say, the two transmitters which would normally be necessary for this purpose can be replaced by a single transmitter.

Figure 3:
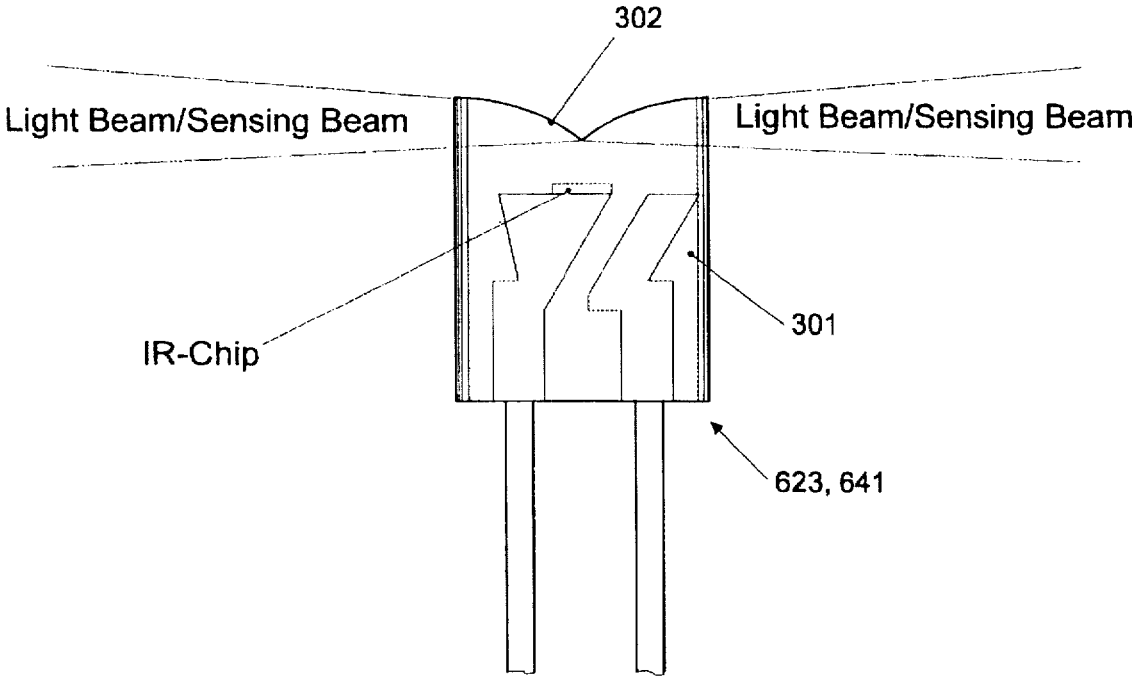

The afore-mentioned division of the transmitted light beam into two light beams at the transmitter element and the formation of two-sided sensing lobes at the receiver is realized by the shaping of the plastic housing 301 shown in FIG. 3. This housing is so laid out that the afore-mentioned beam distribution arises by reason of total reflection at the boundary layer 302 between the plastic and the environmental light or air.

As can be seen from FIG. 4 both the individual transmitters and also the individual receivers are arranged aligned with one another in rows with constant spacing.

In order to increase the sensing resolution, the receivers 641 are arranged to be displaced relative to the transmitters 623 by half the receiver to receiver spacing. Each receiver 641 thus forms light barriers with two transmitters 623 in each of its directions of sensivity. Through this arrangement, a resolution of a half-receiver to receiver spacing results in the center of the channel indicated by chain-dotted lines 351. As a result of this alternate arrangement of transmitters 623 and receivers 641 in the chip tray 102, each receiver 641 is surrounded by two transmitters 623. In order to enable correct sensing, only a neighboring transmitter 623 may be activated for each receiver 641.

The sensing of two columns with the aid of a transmitter 623 and receiver 641 arranged in accordance with FIG. 4 functions in the manner described in the following. For a better understanding of the explanation, the transmitters 623 are split up into two groups, termed here "group 1" and "group 2".

The receiver 641 lying at the lowermost point of the columns is activated; thereafter the light beams 352, 353, 354, 355 are sent out in the following sequence.

1. The light beam 352 from the transmitter 623 of the group 1,
2. The light beam 353 from the transmitter 624 of the group 1,
3. The light beam 354 from the transmitter 625 of the group 2,
4. The light beam 355 from the transmitter 626 of the group 2.

The receiver 641 is subsequently deactivated, the receiver 642 lying above it is activated and the above steps are repeated analogously. In this manner, the total column length is sensed, and the receiver data which is thereby obtained (light beam received or not received) is processed further by the control electronics, i.e. converted into the number of coins or coin-like articles 5 located in the columns. Clearly this system is expanded to cover all the columns of the chip tray 102.

The above assumption, namely that infrared transmitters and receivers are used, represents a particularly preferred embodiment of the invention. The invention is however in no way restricted to the same. In just the same way ultra-violet waves, normal light waves, ultrasonic waves, laser waves, radar waves, or the like, can be used for the build-up of a "measurement curtain". The light transmitters and receivers 623, 641 will be understood to represent transmitters and receivers for other types of wave, so that separate transmitters and receivers for such other wave types are not shown.

Figure 6:
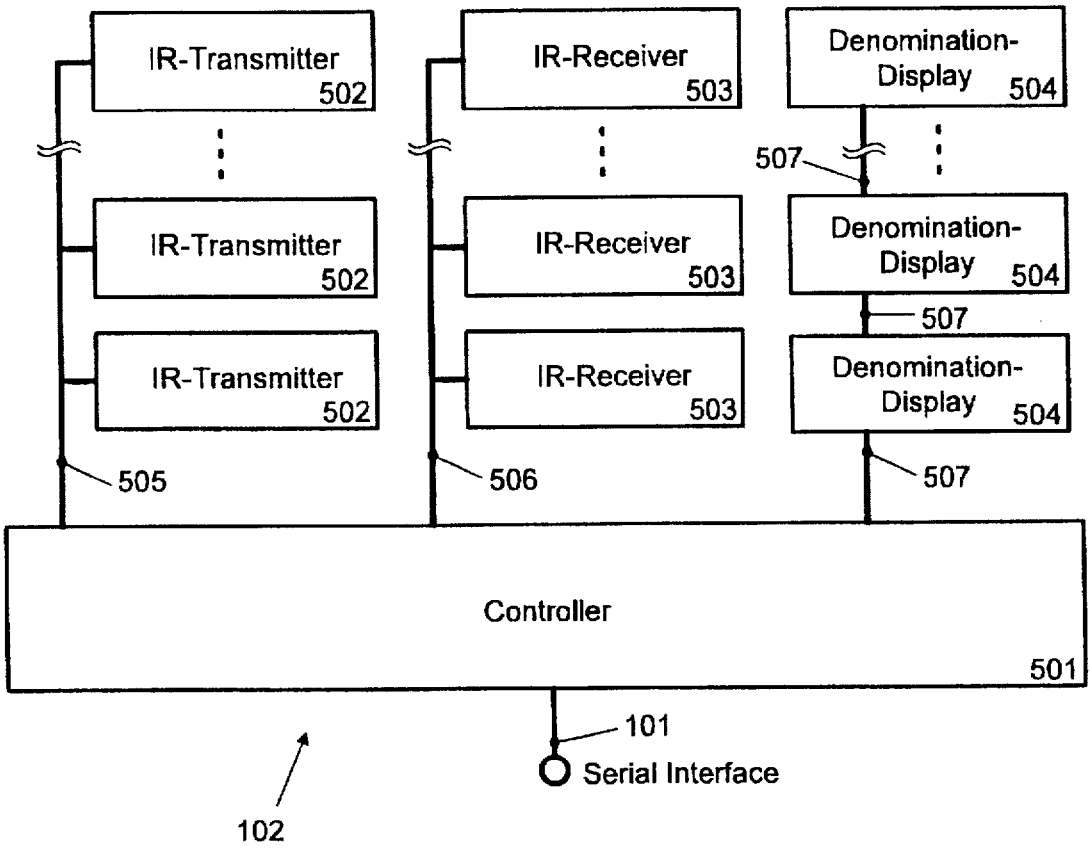

The operation of the apparatus of the chip tray 102 is controlled by a microcontroller 501 shown in block form in FIG. 6. This controls, on the one hand, the mechanism for determining the number of coins or coin-like articles present in the apparatus and computes, on the other hand, the number of coins or coin-like articles contained in the apparatus from the signals received from the apparatus.

Such microcontrollers 501 have been known for a long time in the prior art. The microcontroller of this invention should however preferably have an EEPROM 604 for the present application. The microcontroller 501 is connected to the table keyboard 100 as well as to the central processing unit 104 of FIG. 5. In addition, the microcontroller 501 is connected to optical display elements 504, so-called denomination displays, arranged beneath the columns. Denomination indications, such as the number of the coins or coin-like articles 5 contained in the respective column or the type or value of coins or coin-like articles 5 present in the column, can be displayed on these display elements 504.

Thus, the electronics of the apparatus illustrated schematically in FIG. 6 comprises the constructional groups described below.

The microcontroller 501 makes available the supply voltages and control signals for the subordinate component groups (infrared transmitters and receivers, denomination displays) and evaluates the signals delivered back from the transmitters and receivers.

The microcontroller 501 can be connected via the serial interface 101 to a higher system, for example to a personal computer forming the data processing system 104 (FIG. 5). The detected data and the status and fault information of the chip tray 102 can be transmitted via the serial interface 101. In addition, the denomination displays 504 can be set and diverse configuration data can be transmitted to the microcontroller 501.

The transmitter modules 502 and the receiver modules 503 serve, as already described, for the scanning of the article columns. The transmitters 623 and receivers 641 controlled by the respective transmitter and receiver modules 502, 503 are—in each case alternatingly—mounted beneath the separators 6 between the columns. The transmitters and receivers are respectively connected via common bus cables 505 and 506 to the microcontroller 501.

The denomination displays 504 arranged beneath each column of the chip tray 102 are, for example, formed in the manner of a plurality of luminous diodes or of a numerical display which serves to indicate the chip value or type and the status of the columns. Several display units can also be located on one display module.

Figure 7:
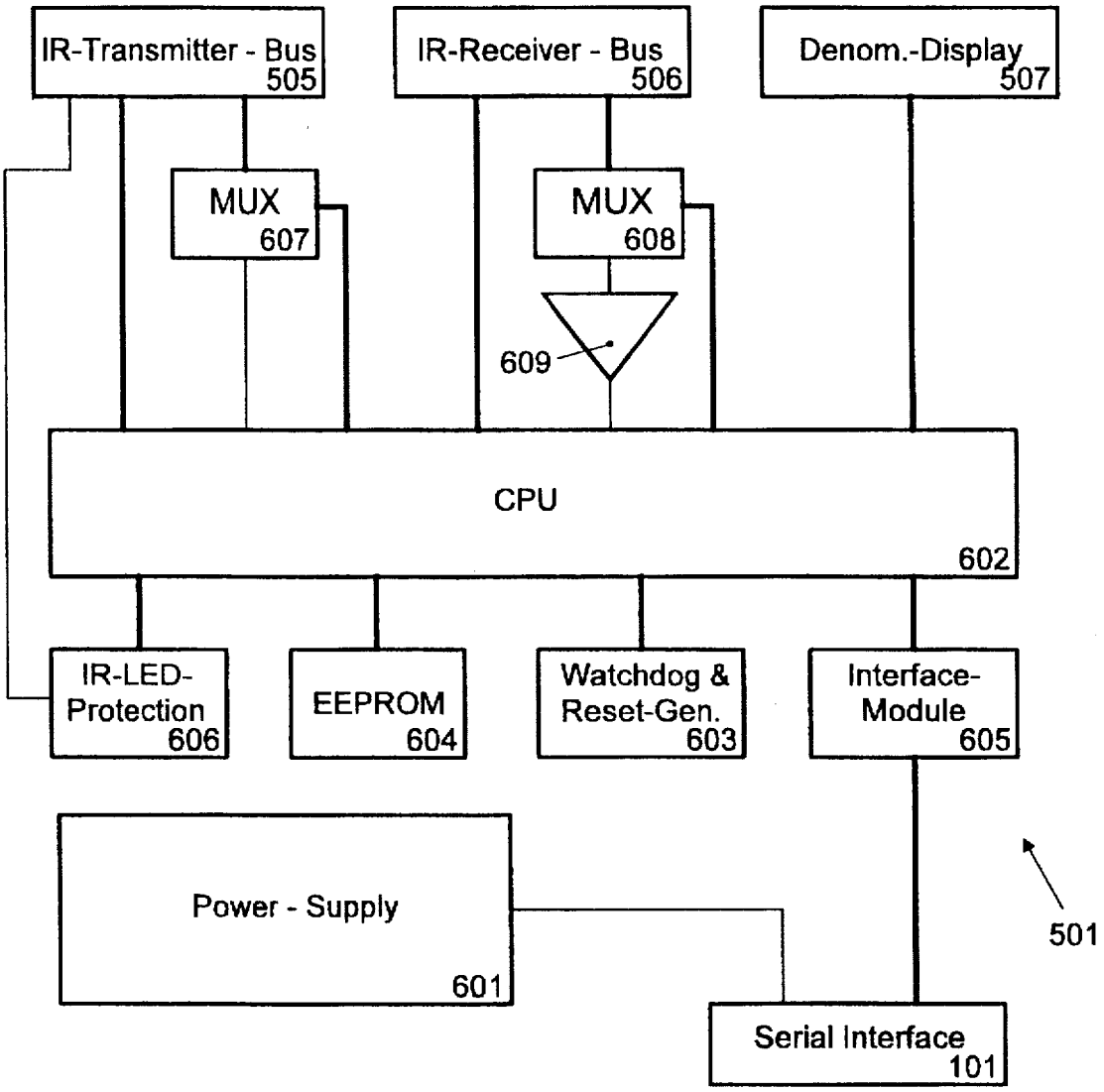

The layout of the microcontroller 501 is illustrated in FIG. 7 in the form of a block circuit diagram. The microcontroller 501 has a central processing unit CPU 602 which is connected to a monitoring module 603 having a reset generator. This is a so-called watchdog circuit, which monitors the correct operation of the microcontroller software. The serial interface 508 of the microcontroller 501 can be matched to various standards (for example RS485 or RS232) by plugging in an interface module 605. Important configuration and calibration data are stored in a non-volatile memory in the form of the EEPROM 604. Large component tolerances arise, with optical semiconductor elements in particular. In order to compensate for the large tolerances, the sensitivities of all the resulting light barriers are measured in a calibration procedure, are stored in the EEPROM 604, and are used as reference values during the evaluation of the measured values from the light barriers in sensing operation.

Since the transmitter diodes of the infrared transmitters are operated with high pulse currents, and since permanent switching-on of the diodes as a result of a fault at the microcontroller 501 would lead to the transmitter modules being damaged, a protection circuit in the form of an IR-LED protection circuit 606 is provided which deactivates the transmitters on exceeding a certain maximum switch-on duration.

The multiplexer MUX 607 serves to select one of the infrared diode monitoring signals delivered by the transmitter modules 502 on the transmitter bus 505. The multiplexer 608 in the receiver circuit serves for the selection of an (analog) receiver output signal on the receiver bus 506. After a level adaption 609, the selected signal is supplied to the internal analog/digital converter of the CPU 602. The reference numeral 601 represents a power supply for the chip tray 102 and can be integrated into the power supply for the other items of the apparatus, such as the items of the apparatus shown in FIG. 5.

Figure 8:
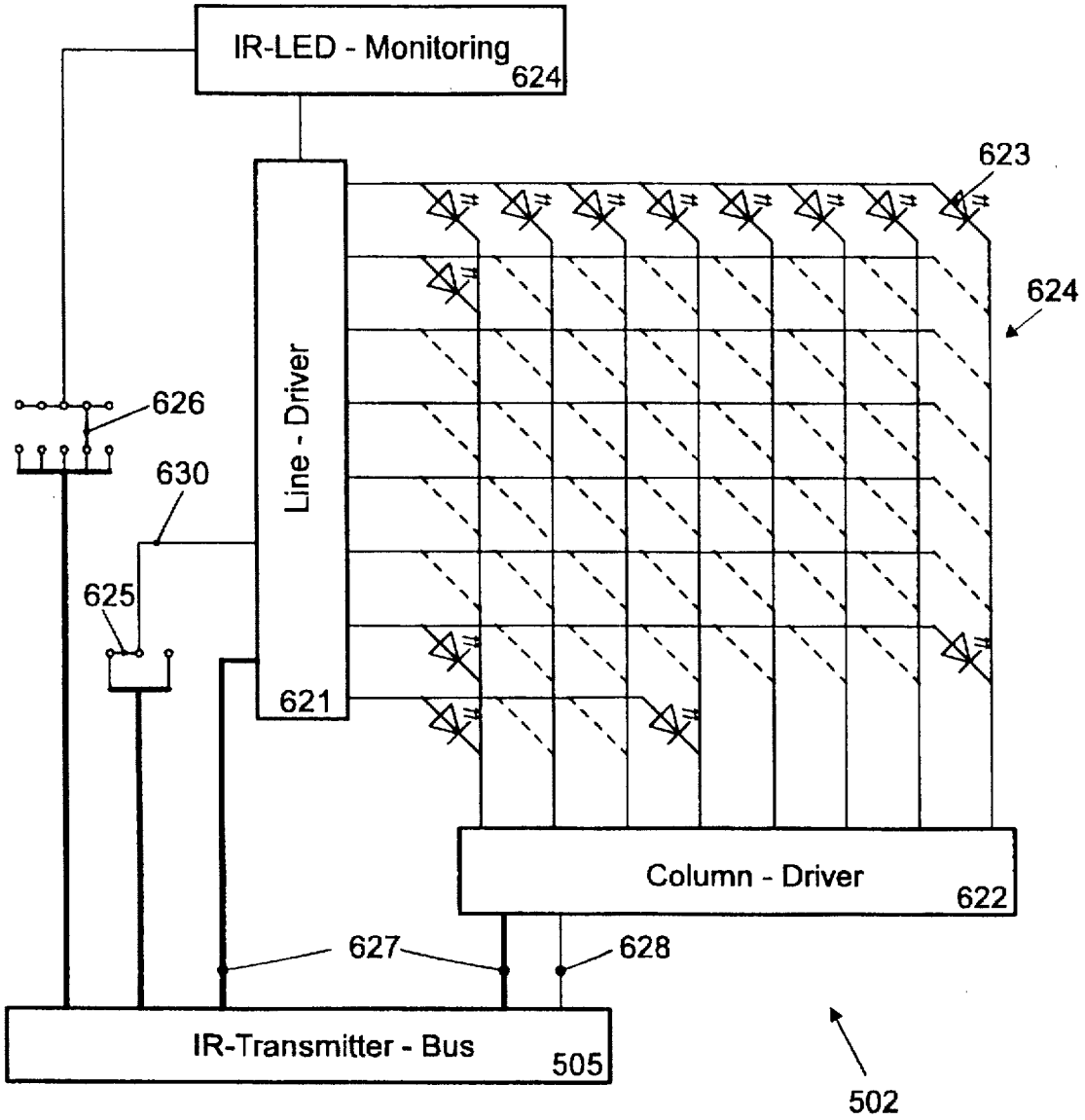

A possible embodiment of the transmitter module 502 is shown in detail in FIG. 8. The infrared diodes 623 of the transmitter module 502 are electrically arranged in a matrix 629. In addition to the address lines 627, the row and column drivers 621, 622 also have a release line 628, 630. The transmitter module 502 is switched on only when both drivers 621, 622 are activated.

With the aid of the release line 630 of the row driver 621, the module 502 is associated with one of the two above-mentioned groups, which association is achieved by a corresponding setting of the jumper (bridge piece) 625. The precise switch-on time or switch-on duration is determined by a release pulse to the column driver 622.

In order to be able to recognize defective infrared diodes 623, the transmitter current is checked by a monitoring circuit 624. The output signal of the current monitoring circuit 624 is associated via a jumper (bridge piece) 626 with one of the corresponding input lines of the controller 501, independently of the mechanical position of the transmitter module 502.

Figure 9:
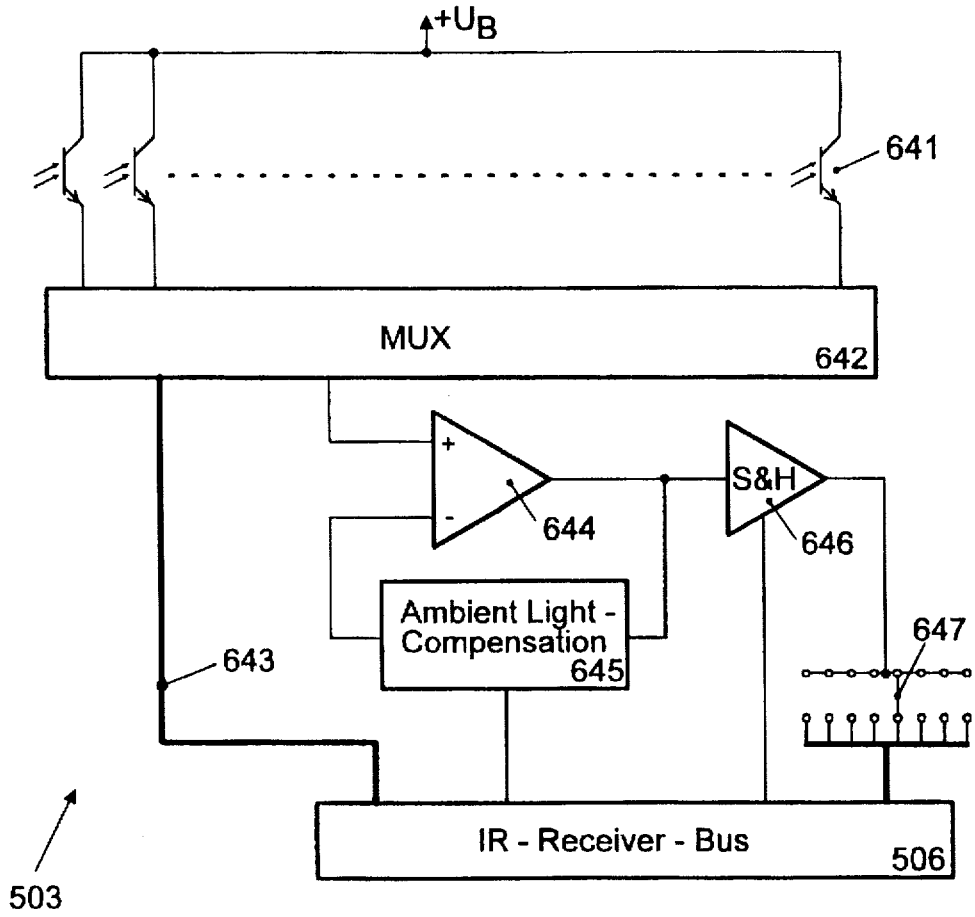

A receiver module 503 is shown in detail in FIG. 9. The selected phototransistor 641 is connected to the measurement amplifier 644 via an analog multiplexer 642 which is controlled by the controller 501 via a part 643 of the receiver bus 506. Prior to the actual measurement, a DC light calibration is carried out by means of an active compensation circuit 645, i.e. the measurement result is free from the influences of ambient light.

With the activation pulse of the infrared transmitter, the sensing and holding member 646 is simultaneously opened which temporarily stores the measured brightness value prior to interrogation and quantization by the controller 501. The output of the receiver at the sensing and holding member 646 is associated by means of a jumper (bridge piece) 647 with a specific input of the controller 501 in accordance with the mechanical position of the receiver module 503 in the chip tray.

Figure 10:
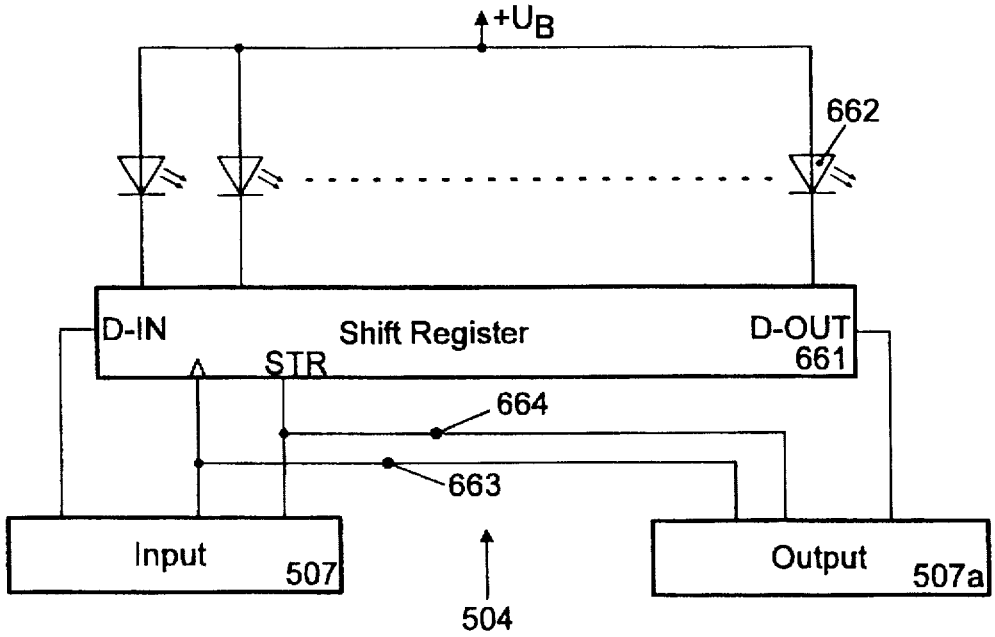

The layout of the denomination display 504 is illustrated in FIG. 10. This uses a shift register 661 with an integrated intermediate memory. The data is written into the shift register 661 by means of a clock signal 663 and is taken into the display by means of a release pulse 664.

The use of the monitoring system for gaming casinos represents a preferred field of application of the invention. A system of this kind, which is shown in block circuit diagram in FIG. 5, can be used to monitor various table games, such as Black Jack, poker, American roulette, etc.

As indicated earlier, the electronic chip tray 102 is located at a gaming table as shown in FIG. 5 and can be served via the table keyboard 100 which is likewise installed at the gaming table. The data lines of the electronic chip tray 102 and of the table keyboard 100 are connected via the interface 101 to a communication processor 103 (FIG. 5) and from there to the system computer 104. The reference numeral 130 refers to an interface module.

The necessary configurations of the chip tray 102, such as the chip value, chip thickness or the like, are either fed in at the input terminal 100 or can be determined at the system computer 104 and communicated to the microcontroller 501 for the chip tray 101.

The monitoring of the table games takes place in such a way that the performance of a croupier or dealer, i.e. the value of his gaming proceeds, is detected. For this purpose, the so-called "table inventory" must be observed and recorded. The table inventory of a gaming table comprises the following:

The supply of gaming chips or simply "chips" which are located with most game types in the chip tray 102 within the reach of the dealer, and the cash of the "dropbox" in which the payments are deposited when purchasing chips.

It is the object of the chip tray 102 to automatically determine the supply of chips at the gaming table.

All non-game dependent changes in the chip inventory——such as chip movements from the chip bank to the table and back: "Fills" and "Credits", "Markers" for the handing out of chips to players in exchange for in-house checks——are passed on to the data processing system manually via the input terminal 100. The cash present in the "Dropbox" is determined by summing up the "drops" (the deposits for each sale of chips by the dealer).

In this manner, the total value of the inventory which is instantaneously present on or at the table and in the chip tray can be determined.

In order to determine the performance of each individual croupier, dealer, or table team, the table inventory must be determined for each change of the croupier, dealer, or team (dealer change). If such a dealer change is effected, then the new dealer identifies himself at the table terminal 100, for example by means of his magnetic card, i.e. advises the data processing system of the change. Thus, the takings of each dealer can be calculated.

What is claimed is:

1. Apparatus for storing coins or coin-like articles to be arranged against one another or above one another in a plurality of columns, the apparatus comprising:

a structure having a plurality of column recesses formed between a plurality of separator means extending parallel to and spaced apart from each other, each of the plurality of columns being disposed in a respective column recess; and a mechanism for determining the number of coins or coin-like articles present in the structure, the determining mechanism comprising a plurality of transmitters and receivers in the form of respective semiconductor elements and arranged in rows within the separator means substantially parallel to the column recesses, only transmitters or only receivers being arranged inside each separator means, the separator means containing transmitters and the separator means containing receivers being alternately arranged within the structure, each transmitter being arranged in one of the separator means for transmitting beams of light across a first column recess and a second column recess disposed adjacent to the transmitter to a pair of receivers disposed in a pair of separator means on opposite sides of the first and second column recesses, the beams traversing the first and second column recesses along lines corresponding to cords of coins or coin-like articles when present in the first and second column recesses.

2. Apparatus in accordance with claim 1, wherein the semiconductor elements comprise infrared transmitters and receivers.

3. Apparatus in accordance with claim 1, wherein the receivers comprise photodiodes.

4. Apparatus in accordance with claim 1, wherein the receivers comprise phototransistors.

5. Apparatus in accordance with claim 1, further comprising means for sequentially activating the receivers and transmitters associated therewith.

6. Apparatus in accordance with claim 5, wherein the activating means comprises a microcontroller.

7. Apparatus in accordance with claim 5, wherein the transmitters and receivers are aligned in alternating rows and spaced by a constant spacing from one another, the receivers are displaced relative to the transmitters by half the receiver-to-receiver spacing, and the determining mechanism is adapted to allow each receiver to sequentially receive light from a first transmitter and a second transmitter arranged in a first row on one side of the receiver and a third transmitter and a fourth transmitter arranged in a second row on an opposite side of the receiver.

8. Apparatus in accordance with claim 1, wherein the transmitters and receivers are aligned in alternating rows spaced by a constant spacing, and the receivers are displaced relative to the transmitters by half the receiver-to-receiver spacing.

9. Apparatus in accordance with claim 1, wherein the determining mechanism comprises multiplexing means for sequentially energizing the transmitters and activating the receivers to sequentially scan the column recesses along the length of the rows.

10. Apparatus in accordance with claim 1, wherein the determining mechanism further comprises a plastic part disposed adjacent an end face of each transmitter to form two light beams emitted in opposite directions.

11. Apparatus in accordance with claim 1, wherein the determining mechanism further comprises a plastic part disposed adjacent an end face of each receiver to form two sensing lobes to opposite sides of the receiver.

12. Apparatus in accordance with claim 1, wherein the determining mechanism further comprises a beam splitter disposed adjacent an end face of each transmitter to form two light beams emitted in opposite directions.

13. Apparatus in accordance with claim 1, wherein the determining mechanism further comprises a beam deflector disposed adjacent an end face of each receiver to form two sensing lobes to opposite sides of the receiver.

14. Apparatus in accordance with claim 1, wherein the structure further comprises a tray into which the separator means are inserted, with sides of the separator means cooperating with portions of the tray to form the column recesses.

15. Apparatus in accordance with claim 14, wherein each separator means has a substantially V-shaped cross-section and has an apex and an open base, the open base facing in a direction opposite to the column recesses and permitting the insertion of the rows of transmitters and receivers into the separator means, the rows of receivers and transmitters being mounted on respective circuit boards, and the circuit boards being mounted on the tray.

16. Apparatus in accordance with claim 15, further comprising means for mounting the circuit boards on the tray at base portions of the column recesses.

17. Apparatus in accordance with claim 1, wherein the separator means are formed of material transparent to the beams of light.

18. Apparatus for storing coins or coin-like articles that are arranged against one another or above one another in at least one column, each column being disposed in a respective column recess, the apparatus comprising:

separators extending parallel to and spaced apart from one another; and mechanism for determining the number of coins or coin-like articles present in the apparatus, the mechanism including a plurality of transmitter/receiver pairs with transmitters and receivers that are arranged in rows substantially parallel to the column recess defined between the separators for storing the at least one column of coins or coin-like articles, the transmitter/receiver pairs for determining the number of the coins or coin-like articles being within the separators, only transmitters or only receivers being arranged inside each separator with the separators containing the transmitters and the separators containing the receivers being alternately arranged, the transmitters and receivers being aligned in rows with a constant spacing from one another wherein the receivers are displaced relative to the transmitters by half the receiver-to-receiver spacing.

19. The apparatus of claim 18, wherein the transmitter/receiver pairs comprise infrared transmitters and receivers.

20. The apparatus of claim 18, wherein the transmitter/receiver pairs comprise optical transmitters and receivers.

21. The apparatus of claim 20, wherein each transmitter transmits two light beams displaced relative to one another by 180° and extending substantially transversely to the separators, and each receiver has two sensitivity lobes displaced by 180° relative to one another and extending substantially transverse to the separators.

22. The apparatus of claim 18, further comprising a microcontroller for controlling the determining mechanism and calculating the number of coins or coin-like articles present in the apparatus from signals received from the determining means.

23. The apparatus of claim 22, further comprising a central processing unit coupled to the microcontroller.

* * * * *